US010375464B2

(12) United States Patent
Wang et al.

(10) Patent No.: US 10,375,464 B2
(45) Date of Patent: Aug. 6, 2019

(54) ADJUSTABLE HEAD-MOUNTED STRUCTURE

(71) Applicant: Qingdao GoerTek Technology Co., Ltd., Qingdao, ShanDong Province (CN)

(72) Inventors: Fujian Wang, Qingdao (CN); Long Yuan, Qingdao (CN); Zengsen Cui, Qingdao (CN)

(73) Assignee: Qingdao GoerTeck Technology Co., Ltd., Qingdao, ShanDong Province (CN)

( * ) Notice: Subject to any disclaimer, the term of this patent is extended or adjusted under 35 U.S.C. 154(b) by 0 days.

(21) Appl. No.: 16/071,813

(22) PCT Filed: Dec. 31, 2016

(86) PCT No.: PCT/CN2016/114039

§ 371 (c)(1),
(2) Date: Jul. 20, 2018

(87) PCT Pub. No.: WO2017/197897

PCT Pub. Date: Nov. 23, 2017

(65) Prior Publication Data

US 2019/0037300 A1 Jan. 31, 2019

(30) Foreign Application Priority Data

May 14, 2016 (CN) ..... 2016 1 0321929

(51) Int. Cl.
*H04R 1/10* (2006.01)
*H04R 5/033* (2006.01)

(52) U.S. Cl.
CPC ..... *H04R 1/1075* (2013.01); *H04R 1/10* (2013.01); *H04R 1/1066* (2013.01); *H04R 5/0335* (2013.01)

(58) Field of Classification Search
CPC . A63F 13/325; G02B 27/0176; G03B 17/561; G06T 19/006; H04N 13/0429;
(Continued)

(56) References Cited

U.S. PATENT DOCUMENTS 3,053,944 A * 9/1962 Weeks ..... H04R 1/1066 381/377
4,302,635 A * 11/1981 Jacobsen ..... H04R 1/1058 381/371
(Continued)

FOREIGN PATENT DOCUMENTS

CN 102196331 A 9/2011
CN 203872330 U 10/2014
(Continued)

OTHER PUBLICATIONS

European Search Report corresponding to European Application No. 16902276, dated Nov. 30, 2018 (4 pages).
(Continued)

*Primary Examiner* — Gerald Gauthier
(74) *Attorney, Agent, or Firm* — Arent Fox LLP

(57) ABSTRACT

An adjustable head-mounted structure comprises overlapping and staggered first and second head strips, one end of each respectively arranged in a groove shaped bracket, the first head strip connected with the bracket. A sliding cavity extending along the first head strip is provided on an end thereof. Limiting slots are provided at lateral intervals of the sliding cavity. An elastic piece is connected with the second head strip having connecting and bending portions in an end notch of the second head strip. The bending, portion is inserted into the sliding cavity and clamped into a limiting slot. A through hole extending along the bracket is provided on a sidewall close to the limiting slot. A button in the bracket has a pressing portion to be inserted into the through hole and connected to a baffle plate, with a fixed connection structure between the baffle plate and the second head strip.

15 Claims, 3 Drawing Sheets

(58) Field of Classification Search
CPC ..... H04R 1/028; H04R 1/10; H04R 1/105; H04R 1/1066; H04R 1/1075; H04R 5/0335
USPC ..... 128/866; 181/129; 224/181; 345/8; 351/156, 158; 359/407, 630; 379/430; 381/361, 370, 371, 376, 377, 378, 383; 455/78; 600/301
See application file for complete search history.

(56) References Cited

U.S. PATENT DOCUMENTS 4,420,657 A * 12/1983 Larkin ..... H04M 1/05 181/129
4,538,034 A * 8/1985 French ..... H04R 5/0335 2/209
4,875,233 A * 10/1989 Derhaag ..... H04M 1/05 379/430
5,099,519 A * 3/1992 Guan ..... H04M 1/05 379/430
5,101,504 A * 3/1992 Lenz ..... H04B 1/385 200/52 R
5,327,178 A * 7/1994 McManigal ..... H04R 1/1066 351/158
5,767,820 A * 6/1998 Bassett ..... G02B 27/017 345/7
5,857,599 A * 1/1999 Palmer ..... F21L 15/14 2/422
6,222,677 B1 * 4/2001 Budd ..... G02B 27/0172 359/630
6,810,987 B1 * 11/2004 DeKalb ..... H04R 1/105 181/129
6,920,228 B2 * 7/2005 Redmer ..... H04R 1/1058 381/370
D830,339 S * 10/2018 Yan ..... D14/206
D836,600 S * 12/2018 Lee ..... D14/206
2004/0070823 A1 * 4/2004 Radna ..... G02B 23/125 359/407
2009/0175478 A1 7/2009 Nakajima et al.
2010/0041962 A1 * 2/2010 Causevic ..... A61B 5/0006 600/301
2013/0064411 A1 * 3/2013 Alstad ..... H04R 1/1033 381/376
2013/0340769 A1 * 12/2013 Roos ..... A61F 11/14 128/866
2015/0077698 A1 * 3/2015 Frank ..... G02C 3/02 351/156
2015/0123881 A1 * 5/2015 Sugihara ..... G02B 27/017 345/8
2016/0249124 A1 * 8/2016 Drinkwater ..... G06F 1/1605
2016/0366503 A1 * 12/2016 Miller ..... H04R 1/028
2017/0075198 A1 * 3/2017 Kuroki ..... F16M 13/04
2017/0128828 A1 * 5/2017 Long ..... A63F 13/235
2018/0003986 A1 * 1/2018 Guo ..... G02B 27/0176
2018/0150996 A1 * 5/2018 Gatta ..... G06F 3/013
2018/0213212 A1 * 7/2018 Liu ..... H04N 13/332
2018/0239151 A1 * 8/2018 Chang ..... G02B 27/0176
2019/0037300 A1 * 1/2019 Wang ..... H04R 1/1066

FOREIGN PATENT DOCUMENTS

CN 203984632 U 12/2014
CN 104618830 A 5/2015
CN 105049980 A 11/2015
CN 205081913 U 3/2016
CN 105792052 A 7/2016
CN 205793150 U 12/2016
EP 2779694 A1 9/2014
EP 2887693 A1 6/2015

OTHER PUBLICATIONS

Chinese Office Action issued in Chinese Application No. 201610321929.3 dated Apr. 2, 2018.
Chinese Search Report issued in Chinese Application No. 201610321929.3.
International Search Report and Written Opinion issued in International Patent Application No. PCT/CN2016/114039 dated Mar. 1, 2017.

* cited by examiner

ADJUSTABLE HEAD-MOUNTED STRUCTURE

CROSS REFERENCE TO RELATED APPLICATIONS

This application is a U.S. National Stage entry under 35 U.S.C. § 371 based on International Application No. PCT/CN2016/114039, filed on Dec. 31, 2016, which was published under PCT Article 21(2) and which claims priority to Chinese Patent Application No. 201610321929.3, filed on May 14, 2016. The disclosure of the priority applications are hereby incorporated herein in their entirety by reference.

TECHNICAL FIELD

The present disclosure belongs to the technical field of head-mounted products, and particularly relates to an adjustable head-mounted structure.

BACKGROUND ART

With the development of technology and the increase of user demand, more stringent requirements have been made on the wearing of headsets. Different users require different wearing lengths and different gripping forces.

SUMMARY OF THE DISCLOSURE

The present disclosure is implemented by an adjustable head-mounted structure comprising an upper sheath, a groove-shaped bracket and a lower sheath which are integrated together. The adjustable head-mounted structure further comprises:

a first head strip and a second head strip, wherein one end of each of the first head strip and the second head strip is respectively arranged in the groove-shaped bracket; the ends of the first head strip and the second head strip are arranged in an overlapped and staggered manner; the first head strip is fixedly connected with the groove-shaped bracket; a sliding cavity extending in a length direction of the first head strip is provided at the end of the first head strip; a plurality of limiting slots are provided at intervals at a lateral side of the sliding cavity extending in the length direction of the sliding cavity, and a notch is provided at the end of the second head strip;

an elastic piece fixedly connected with the second head strip, wherein the elastic piece comprises a connecting portion and a bending portion which is connected with the connecting portion and located in the notch; the bending portion is inserted into the sliding cavity and clamped into one of the limiting slots;

an elongated through hole extending in the length direction of the groove-shaped bracket provided on a sidewall of the groove-shaped bracket which is close to the limiting slot; and a button provided in the groove-shaped bracket and connected with the bending portion, wherein the button comprises a pressing portion passing through the elongated through hole and a baffle plate connected with the pressing portion, and a fixed connection structure is provided between the baffle plate and the second head strip.

In some embodiments, the bending portion is U-shaped, and a connecting hole is provided on a sidewall of the bending portion which is close to the limiting slot; a connecting column which is to be inserted into the connecting hole is provided on the baffle plate; a pressing plate is further provided between the connecting column and the baffle plate.

In some embodiments, a U-shaped retaining wall is provided around the connecting column; the distance between outer sides of the two opposing sidewalls of the retaining wall is the same as the width of the notch in the direction of the length of the second head strip; the length of the retaining wall is greater than the length of the notch in the direction of the width of the second head strip; and an extending portion which is to be inserted into the notch is provided respectively on each sidewall of the retaining wall.

In some embodiments, the pressing portion, the baffle plate, the pressing plate, the connecting column, the retaining wall and the extending portion are integrally injection molded.

In some embodiments, the fixed connection structure comprises ridges provided at intervals on the baffle plate and clamping grooves correspondingly provided at a lateral side of the second head strip; or, the fixed connection structure comprises clamping grooves provided at intervals on the baffle plate and ridges correspondingly provided at a lateral side of the second head strip; the ridges are clamped into the corresponding clamping grooves.

In some embodiments, a plurality of protrusions are provided at intervals at a lateral side of the sliding cavity extending in its length direction; a limiting slot is formed respectively between two adjacent protrusions, or between the most marginal protrusion and its adjacent sidewall of the sliding cavity.

In some embodiments, the length of the sliding cavity is greater than or equal to the length of the elongated through hole.

In some embodiments, the sliding cavity is a rectangular hole penetrating the first head strip, or the sliding cavity is an elongated groove disposed at the lateral side of the first head strip.

In some embodiments, the elastic piece is a metal piece integrally formed by bending.

When the wearing length needs to be adjusted, the pressing portion of the button is pressed. Since the button is connected with the bending portion, the bending portion is pressed and elastically deformed so that the bending portion is separated from the limiting slot. At this point, the button slides in the direction of the elongated through hole. Since the baffle plate of the button is fixedly connected with the second head strip, the button can drive the second head strip to move in the extending direction of the groove-shaped bracket, and by changing the overlapping length of the first head strip and the second head strip, the overall wearing length can be changed. So it is very convenient to adjust the wearing length.

When moving to a suitable position, the pressing portion of the button is released, and under the elastic force of the bending portion, the bending portion is clamped into another limiting slot, and the position is fixed, the relative length between the first head strip and the second head strip will no longer change, and thus the problem that the position cannot be fixed after the headset is adjusted in place is solved.

BRIEF DESCRIPTION OF DRAWINGS

The present disclosure will hereinafter be described in conjunction with the following drawing figures, wherein like numerals denote like elements, and.

Figure 1:
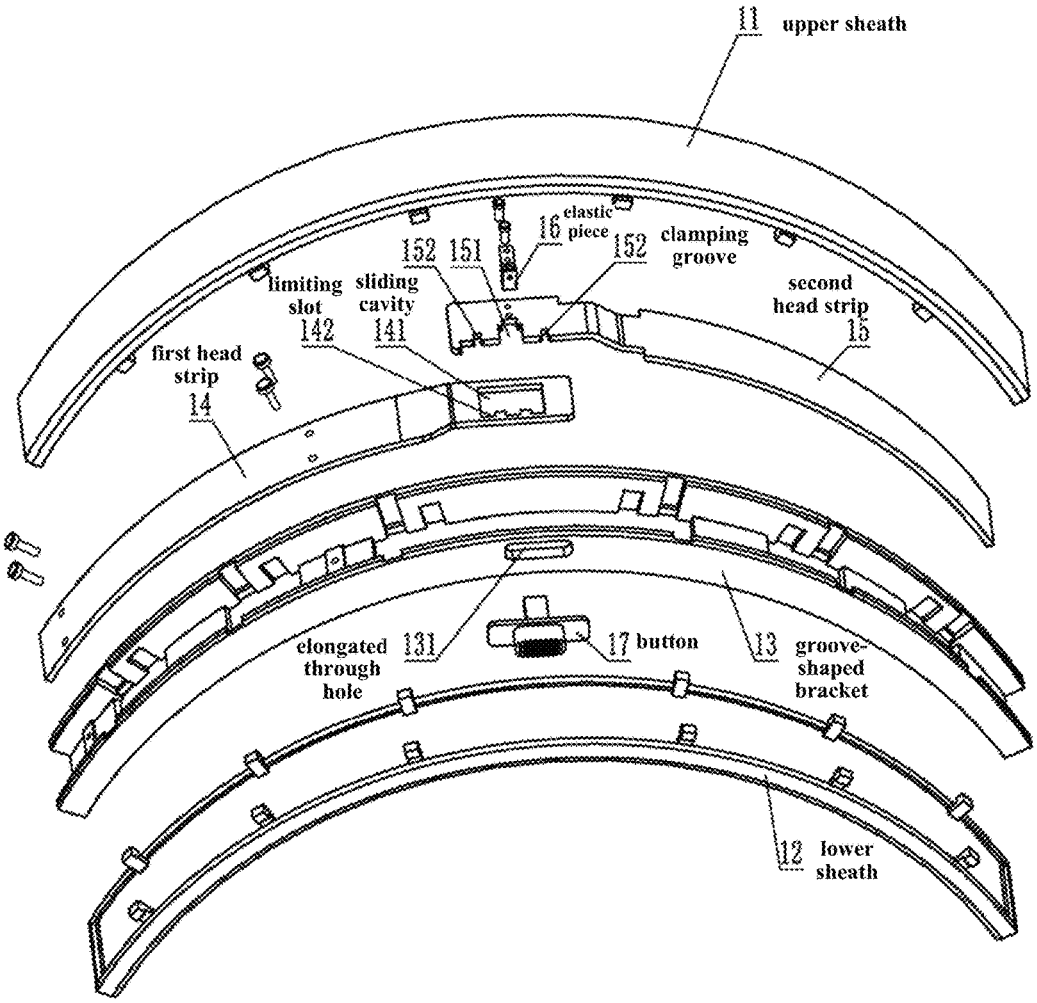
FIG. 1 is a schematic exploded view of an adjustable head-mounted structure according to an embodiment of the present disclosure.

In the drawings; 11, upper sheath; 12, lower sheath; 13, groove-shaped bracket; 131, elongated through hole; 14, first head strip; 141, sliding cavity; 142, limiting slot; 15, second head strip; 151, notch; 152, clamping groove; 16, elastic piece; 161, connecting portion; 162, bending portion; 163, connecting hole; 17, button; 171, pressing portion; 172, baffle plate; 173, connecting column; 174, pressing plate; 175, ridge; 176, retaining wall; 177, extending portion.

DETAILED DESCRIPTION

In order to make the objectives, technical solutions and advantages of the present disclosure more comprehensible, the present disclosure is further described in detail with reference to the accompanying drawings and the embodiments. It should be understood that the specific embodiments described herein are only used to explain the present disclosure and are not intended to limit the present disclosure.

Figure 2:
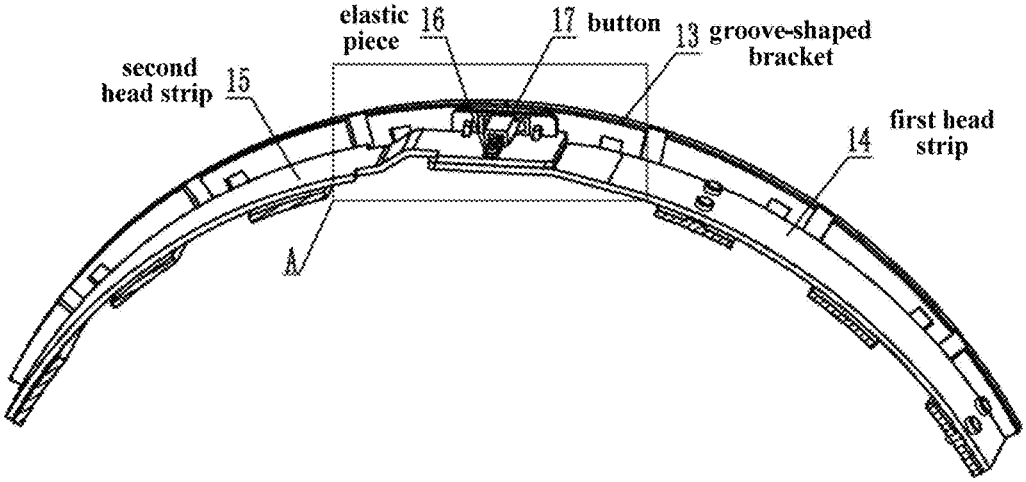
FIG. 2 is a schematic sectional view of an adjustable head-mounted structure according to an embodiment of the present disclosure.
Figure 3:
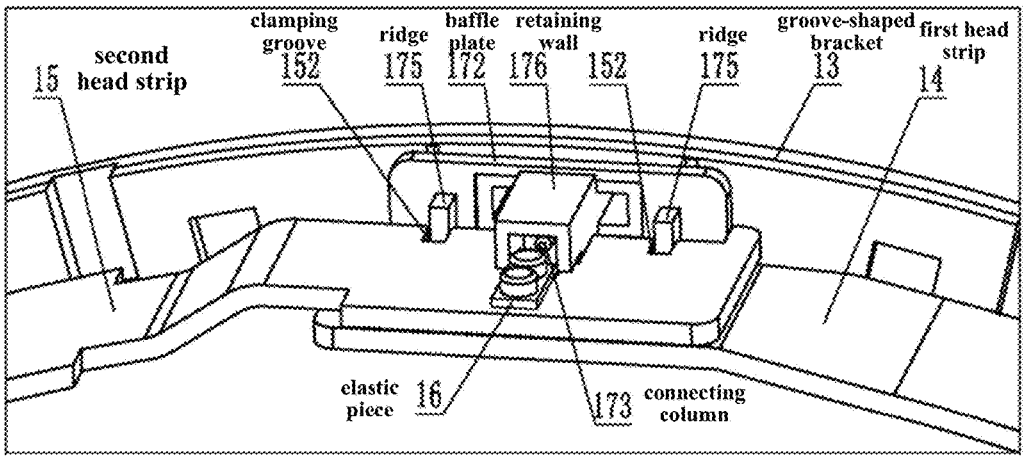
FIG. 3 is an enlarged schematic view of part. A in FIG. 2.
Figure 4:
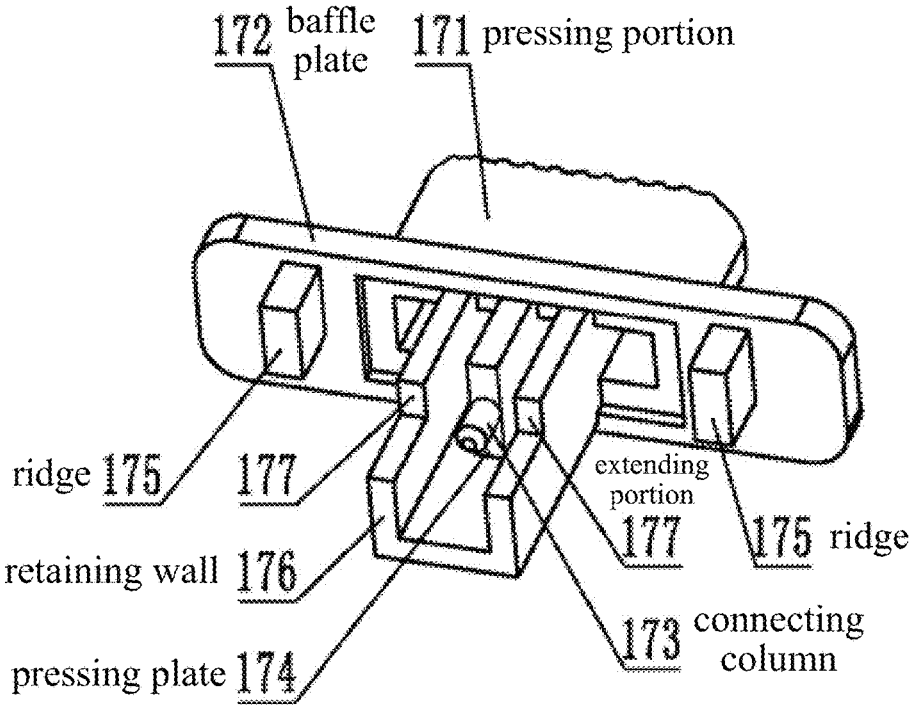
FIG. 4 is a schematic perspective view of a button of an adjustable head-mounted structure according to an embodiment of the present disclosure.
Figure 5:
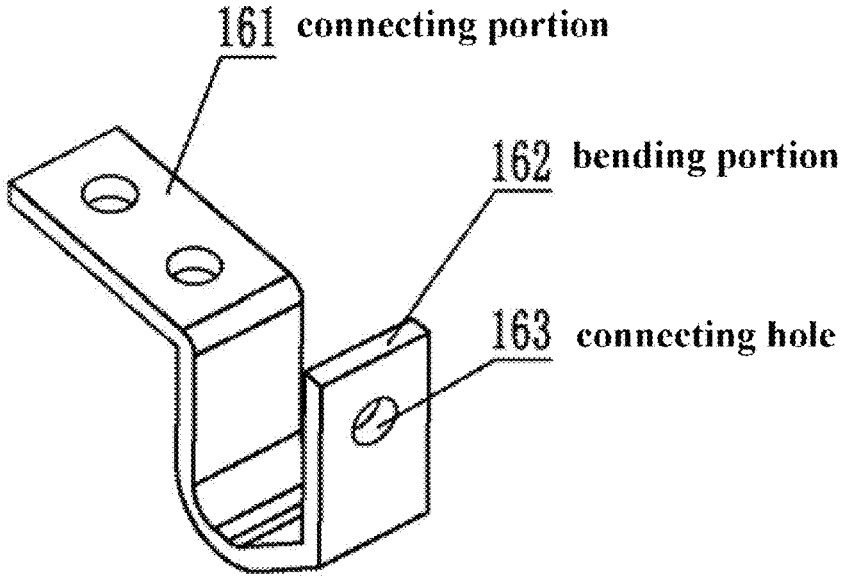
FIG. 5 is a schematic perspective view of an elastic piece of an adjustable head-mounted structure according to an embodiment of the present disclosure.

As can be seen from FIGS. 1 to 5, the adjustable head-mounted structure comprises an upper sheath 11, a groove-shaped bracket 13 and a lower sheath 12 which are integrated in sequence. The upper sheath 11 is disposed at the side of the notch of the groove-shaped bracket 13. The lower sheath 12 is disposed at the side of the bottom surface of the groove-shaped bracket 13. Specifically, a plurality of clamping heads are provided on the upper sheath 11 and the lower sheath 12 respectively at positions close to a lateral side thereof, and correspondingly, a plurality of clamping grooves are provided at the inner side of the groove wall of the groove-shaped bracket 13.

The adjustable head-mounted structure further comprises a first head strip 14 and a second head strip 15, one end of each of whom is respectively arranged in the groove-shaped bracketed 13. The ends of the first head strip 14 and the second head strip 15 are arranged in an overlapped and staggered manner. The first head strip 14 is fixedly connected with the groove-shaped bracket 13, specifically, by screws. A sliding cavity 141 extending in the length direction of the first head strip 14 is provided at the end of the first head strip 14. A plurality of limiting slots 142 are provided at intervals at a lateral side of the sliding cavity 141 extending in the length direction of the sliding cavity 141, and a notch 151 is provided at the end of the second head strip 15. In some embodiments, the sliding cavity 141 is a rectangular hole penetrating the first head strip 14, and of course it may also be an elongated groove disposed at the lateral side of the first head strip 14.

The adjustable head-mounted structure further comprises an elastic piece 16 fixedly connected with the second head strip 15. The elastic piece 16 comprises a connecting portion 161 and a bending portion 162 which is connected with the connecting portion 161 and located in the notch 151. The bending portion 162 is inserted into the sliding cavity 141 and clamped into one of the limiting slots 142. Specifically, the connecting portion 161 is connected with the second head strip 15 by screws.

On a sidewall of the groove-shaped bracket 13 which is close to the limiting slot 142, an elongated through hole 131 extending in the length direction of the groove-shaped bracket 13 is provided. A button 17 is provided in the groove-shaped bracket 13 and is connected with the bending portion 162 of the elastic piece 16. The button 17 comprises a pressing portion 171 passing through the elongated through hole 131 and a baffle plate 172 connected with the pressing portion 171. A fixed connection structure is provided between the baffle plate 172 and the second head strip 15.

When the wearing length needs to be adjusted, the pressing portion 171 of the button 17 is pressed. Since the button 17 is connected with the bending portion 162, the bending portion 162 is pressed and elastically deformed so that the bending portion 162 is separated from the limiting slot 142. At this point, the button 17 slides in the direction of the elongated through hole 131. Since the baffle plate 172 of the button 17 is fixedly connected with the second head strip 15, the button 17 can drive the second head strip 15 to move in the extending direction of the groove-shaped bracket 13, and by changing the overlapping length of the first head strip 14 and the second head strip 15, the overall wearing length can be changed. So it is very convenient to adjust the wearing length. If the overall wearing length changes, the corresponding curvature of arc will change, and different pressing forces will produce. When moving to a suitable position, the pressing portion 171 of the button 17 is released, and under the elastic force of the bending portion 162, the bending portion 162 is clamped into another limiting slot 142, and the position is fixed, the relative length between the first head strip 14 and the second head strips 15 will no longer change, and thus the problem that the position cannot be fixed after the headset is adjusted in place is solved.

In some embodiments, the fixed connection structure comprises ridges 175 provided at intervals on the baffle plate 172 and clamping grooves 152 correspondingly provided at a lateral side of the second head strip 15. The ridges 175 are clamped into the corresponding clamping grooves 152, and thus the baffle plate 172 and the second head strip 15 are fixedly connected together. Of course, the clamping groove may also be disposed on the baffle plate 172, and the ridges may be disposed at a lateral side of the second head strip 15, and the ridges are clamped into the corresponding clamping grooves.

In some embodiments, the bending portion 162 is U-shaped. A connecting hole 163 is provided on a sidewall of the bending portion 162 which is close to the limiting slot 142. A connecting column 173 which is to be inserted into the connecting hole 163 is provided on the baffle plate 172. A pressing plate 174 is further provided between the connecting column 173 and the baffle plate 172. When the pressing portion 171 of the button 17 is pressed, the pressing plate 174 presses the bending portion 162, and the connection between the button 17 and the bending portion 162 of the elastic piece 16 is realized by the connecting column 173, thereby avoiding skew when pressed.

A U-shaped retaining wall 176 is provided around the connecting column 173. The distance between the outer sides of the two opposing sidewalls is the same as the width of the notch 151 in the direction of the length of the second head strip 15. The length of the retaining wall 176 is greater than the length of the notch 151 in the direction of the width of the second head strip 15. An extending portion 177 which is to be inserted into the notch 151 is provided respectively on each sidewall of the retaining wall 176, and therefore the connection performance between the button 17 and the second head strip 15 can be enhanced.

In some embodiments, the pressing portion 171, the baffle plate 172, the pressing plate 174, the connecting column 173, the retaining wall 176 and the extending portion 177 are integrally injection molded.

In some embodiments, a plurality of protrusions are provided at intervals at a lateral side of the sliding cavity 141 extending in its length direction. A limiting slot 142 is formed respectively between two adjacent protrusions, or between the most marginal protrusion and its adjacent sidewall of the sliding cavity 141.

In some embodiments, the length of the sliding cavity 141 is greater than or equal to the length of the elongated through hole 131, so that the length of the elongated through hole 131 can be fully used, and the adjustable length range is also limited to the length of the elongated through hole 131.

In some embodiments, the elastic piece 16 is a metal piece integrally formed by bending, which is convenient for processing and can improve production efficiency.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. An adjustable head-mounted structure, comprising an upper sheath, a groove-shaped bracket and a lower sheath which are integrated together, wherein the adjustable head-mounted structure further comprises:

a first head strip and a second head strip, wherein one end of each of the first head strip and the second head strip is respectively arranged in the groove-shaped bracket; the ends of the first head strip and the second head strip are arranged in an overlapped and staggered manner; the first head strip is fixedly connected with the groove-shaped bracket; a sliding cavity extending in a length direction of the first head strip is provided at the end of the first head strip; a plurality of limiting slots are provided at intervals at a lateral side of the sliding cavity extending in the length direction of the sliding cavity, and a notch is provided at the end of the second head strip;

an elastic piece fixedly connected with the second head strip, wherein the elastic piece comprises a connecting portion and a bending portion which is connected with the connecting portion and located in the notch; the bending portion is inserted into the sliding cavity and clamped into one of the limiting slots;

an elongated through hole extending in the length direction of the groove-shaped bracket provided on a sidewall of the groove-shaped bracket which is close to the limiting slot; and a button provided in the groove-shaped bracket and connected with the bending portion, wherein the button comprises a pressing portion passing through the elongated through hole and a baffle plate connected with the pressing portion, and a fixed connection structure is provided between the baffle plate and the second head strip.

2. The adjustable head-mounted structure according to claim 1, wherein the bending portion is U-shaped, and a connecting hole is provided on a sidewall of the bending portion which is close to the limiting slot;

a connecting column which is to be inserted into the connecting hole is provided on the baffle plate; and a pressing plate is further provided between the connecting column and the baffle plate.

3. The adjustable head-mounted structure according to claim 2, wherein a U-shaped retaining wall is provided around the connecting column;

the distance between outer sides of the two opposing sidewalls of the retaining wall is the same as the width of the notch in the direction of the length of the second head strip;

the length of the retaining wall is greater than the length of the notch in the direction of the width of the second head strip; and an extending portion which is to be inserted into the notch is provided respectively on each sidewall of the retaining wall.

4. The adjustable head-mounted structure according to claim 3, wherein the pressing portion, the baffle plate, the pressing plate, the connecting column, the retaining wall and the extending portion are integrally injection molded.

5. The adjustable head-mounted structure according to claim 1, wherein the fixed connection structure comprises ridges provided at intervals on the baffle plate and clamping grooves correspondingly provided at a lateral side of the second head strip;

or, the fixed connection structure comprises clamping grooves provided at intervals on the baffle plate and ridges correspondingly provided at a lateral side of the second head strip; and the ridges are clamped into the corresponding clamping grooves.

6. The adjustable head-mounted structure according to claim 5, wherein a plurality of protrusions are provided at intervals at a lateral side of the sliding cavity;

a limiting slot is formed respectively between two adjacent protrusions, or between the most marginal protrusion and its adjacent sidewall of the sliding cavity.

7. The adjustable head-mounted structure according to claim 1, wherein the length of the sliding cavity is greater than or equal to the length of the elongated through hole.

8. The adjustable head-mounted structure according to claim 7, wherein the sliding cavity is a rectangular hole penetrating the first head strip, or the sliding cavity is an elongated groove disposed at the lateral side of the first head strip.

9. The adjustable head-mounted structure according to claim 1, wherein the elastic piece is a metal piece integrally formed by bending.

10. The adjustable head-mounted structure according to claim 2, wherein the fixed connection structure comprises ridges provided at intervals on the baffle plate and clamping grooves correspondingly provided at a lateral side of the second head strip;

or, the fixed connection structure comprises clamping grooves provided at intervals on the baffle plate and ridges correspondingly provided at a lateral side of the second head strip; and the ridges are clamped into the corresponding clamping grooves.

11. The adjustable head-mounted structure according to claim 10, wherein a plurality of protrusions are provided at intervals at a lateral side of the sliding cavity;

a limiting slot is formed respectively between two adjacent protrusions, or between the most marginal protrusion and its adjacent sidewall of the sliding cavity.

12. The adjustable head-mounted structure according to claim 3, wherein the fixed connection structure comprises ridges provided at intervals on the baffle plate and clamping grooves correspondingly provided at a lateral side of the second head strip;

or, the fixed connection structure comprises clamping grooves provided at intervals on the baffle plate and ridges correspondingly provided at a lateral side of the second head strip; and the ridges are clamped into the corresponding clamping grooves.

13. The adjustable head-mounted structure according to claim 12, wherein a plurality of protrusions are provided at intervals at a lateral side of the sliding cavity;

a limiting slot is formed respectively between two adjacent protrusions, or between the most marginal protrusion and its adjacent sidewall of the sliding cavity.

14. The adjustable head-mounted structure according to claim 4, wherein the fixed connection structure comprises ridges provided at intervals on the baffle plate and clamping grooves correspondingly provided at a lateral side of the second head strip;

or, the fixed connection structure comprises clamping grooves provided at intervals on the baffle plate and ridges correspondingly provided at a lateral side of the second head strip; and the ridges are clamped into the corresponding clamping grooves.

15. The adjustable head-mounted structure according to claim 14, wherein a plurality of protrusions are provided at intervals at a lateral side of the sliding cavity;

a limiting slot is formed respectively between two adjacent protrusions, or between the most marginal protrusion and its adjacent sidewall of the sliding cavity.

* * * * *